US010006219B1

(12) United States Patent
Mehrain

(10) Patent No.: US 10,006,219 B1
(45) Date of Patent: Jun. 26, 2018

(54) FRAME ASSEMBLY FOR SEISMIC RETROFITTING OF SOFT STORY BUILDINGS

(71) Applicant: Mehrdad Mehrain, Los Angeles, CA (US)

(72) Inventor: Mehrdad Mehrain, Los Angeles, CA (US)

( * ) Notice: Subject to any disclaimer, the term of this patent is extended or adjusted under 35 U.S.C. 154(b) by 0 days. days.

(21) Appl. No.: 15/470,278

(22) Filed: Mar. 27, 2017

(51) Int. Cl.

| | |
|---|---|
| ***E04H 9/02*** | (2006.01) |
| ***E04B 1/24*** | (2006.01) |
| ***E04B 1/98*** | (2006.01) |
| ***E04C 3/18*** | (2006.01) |

(52) U.S. Cl.
CPC ..... *E04H 9/027* (2013.01); *E04B 1/2403* (2013.01); *E04B 1/98* (2013.01); *E04C 3/18* (2013.01); *E04H 9/024* (2013.01); *E04B 2001/2415* (2013.01); *E04B 2001/2466* (2013.01)

(58) Field of Classification Search
CPC . E04H 9/027; E04H 9/024; E04B 1/98; E04B 1/2403; E04B 2001/2466; E04B 2001/2415; E04C 3/18
See application file for complete search history.

(56) References Cited

U.S. PATENT DOCUMENTS 797,474 A * 8/1905 Walker ..... E04H 15/18 52/63
2,931,129 A * 4/1960 Boniface ..... A63H 33/101 211/182
3,414,300 A * 12/1968 Spane ..... E04B 1/2604 403/300
3,425,720 A * 2/1969 Spane ..... E04B 1/2604 403/230
3,740,084 A * 6/1973 Tellberg ..... B63C 15/00 182/204
3,836,270 A * 9/1974 Chambers ..... E04B 1/2604 403/205
4,342,177 A * 8/1982 Smith ..... E04B 1/24 403/188
4,411,547 A * 10/1983 Johnson ..... E04C 3/42 403/205
5,524,397 A * 6/1996 Byers ..... E04B 1/2608 403/232.1
5,588,265 A * 12/1996 Gill ..... E04H 9/02 52/167.1

(Continued)

FOREIGN PATENT DOCUMENTS

CN 203626237 U * 6/2014

*Primary Examiner* — Jeanette E Chapman
(74) *Attorney, Agent, or Firm* — Holland & Knight LLP

(57) ABSTRACT

A metal frame assembly for seismic retrofitting of soft story buildings comprising a pair of half frame subassemblies. Each subassembly comprises front and rear steel column portions and front and rear steel beam portions. The column portions are configured to extend about and substantially encase the existing column of a wooden frame. The front and rear beam portions are secured to and carried by upper portions of the column portions in each subassembly and extend therefrom parallel to and laterally spaced from opposed sides of the beam in the wooden frame. Connector plates are provided in each subassembly securing together the front beam and column portions to the rear beam and column portions and the front and rear column and beam portions to the beam of the wooden frame.

40 Claims, 11 Drawing Sheets

(56) References Cited

U.S. PATENT DOCUMENTS

| | | | | |
|---|---|---|---|---|
| 5,628,156 | A | 5/1997 | Tarics | |
| 5,660,017 | A | 8/1997 | Houghton | |
| 5,735,087 | A * | 4/1998 | Olden | E04B 1/2608 52/693 |
| 6,219,975 | B1 * | 4/2001 | Olden | E04B 1/2608 52/712 |
| 7,021,020 | B2 | 4/2006 | Simmons et al. | |
| 7,941,985 | B2 | 5/2011 | Simmons | |
| 8,745,954 | B2 | 6/2014 | Simmons | |
| 9,066,585 | B2 | 6/2015 | Kirby | |
| 2010/0205891 | A1 * | 8/2010 | Bong | B23K 33/004 52/655.1 |

* cited by examiner

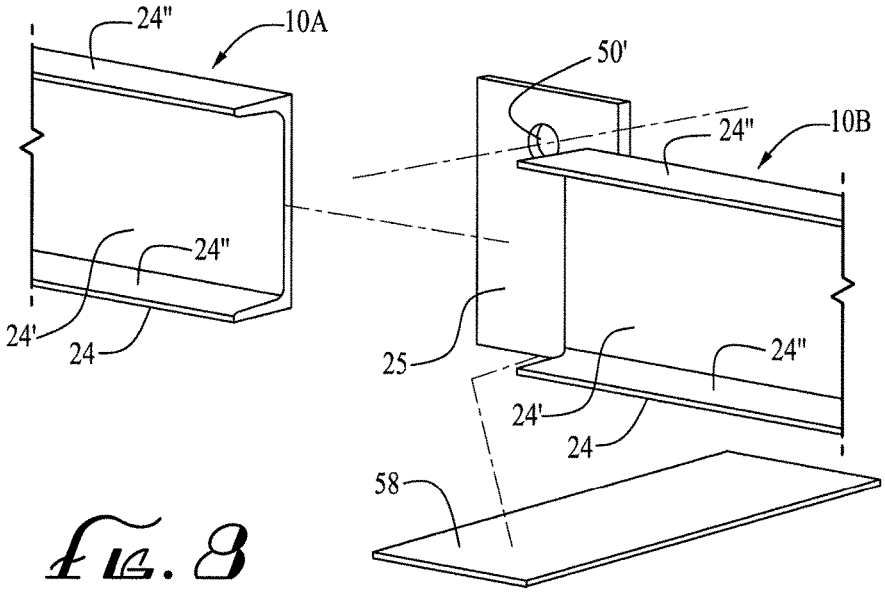
FIG. 8
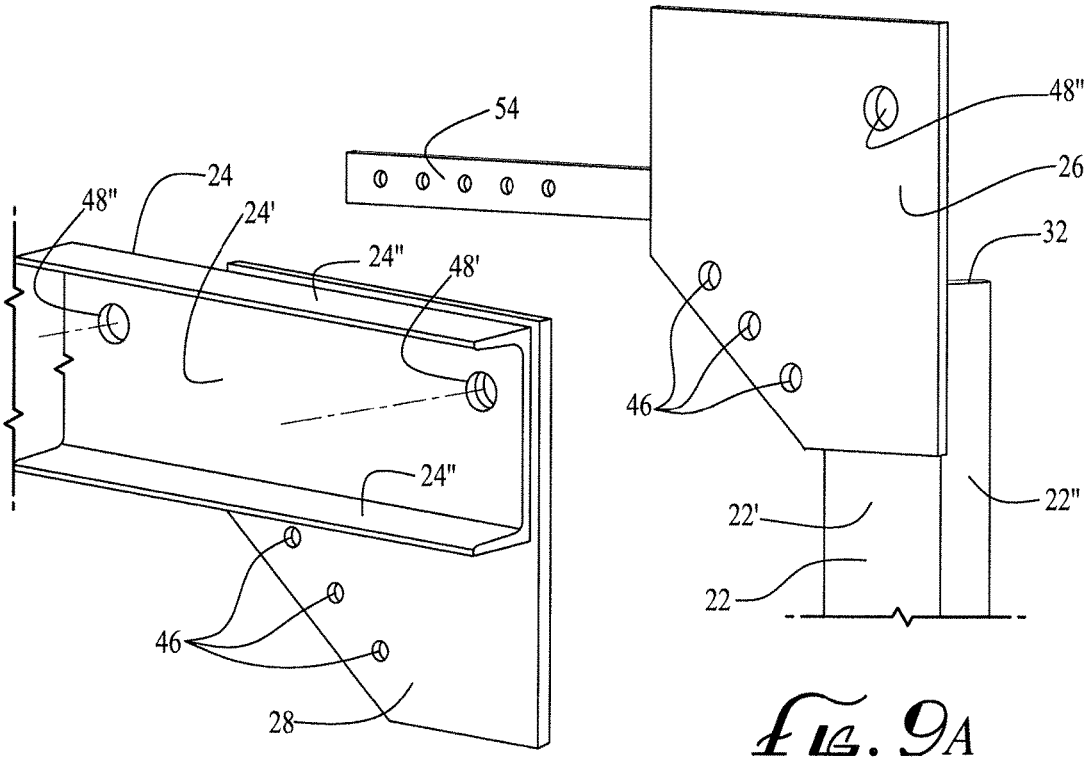
FIG. 9A
FIG. 9B

FRAME ASSEMBLY FOR SEISMIC RETROFITTING OF SOFT STORY BUILDINGS

BACKGROUND OF THE INVENTION

The present invention relates to seismic retrofitting of soft story buildings. Soft story buildings are multi-story, wooden framed structures, typically having two to four floors, and wide doors or other large openings. These structures were built in the 1950s, '60s and '70s and typically used for apartments and condominiums and with large openings on the ground floor providing the entrance to a parking garage. This configuration also is referred to as "tuck-under" parking. To maximize the number of parking spaces, such buildings typically have little or no walls on the exterior line of the first story. Soft story buildings are very vulnerable to collapse in moderate to severe earthquakes and were responsible for a substantial number of the homes that became uninhabitable in California's Loma Prieta earthquake of 1989 and the Northridge earthquake of 1994, among others. As a result, San Francisco, and more recently Los Angeles, have adopted ordinances targeting soft story apartment buildings and requiring retrofitting by reinforcing the "soft-story" condition. Several other cities and municipalities in California are following suit. Current California building codes now require that the exterior line of columns in tuck-under parking areas be designed with sufficient strength and stiffness to prevent their collapse. In some cases, the wooden beams in soft story buildings are supported by columns formed of steel tubing typically four inches or less in diameter. Such structures also are referred to as soft story buildings and also are very vulnerable in earthquakes. Newer buildings having tuck-under parking typically use conventional steel moment frames instead of wood columns and beams in the tuck-under portion of the structure.

To comply with the ordinances requiring seismic retrofitting of soft story buildings, the conventional solution has been to construct a new steel frame under the existing building adjacent to the existing wooden frame. The new steel frame is independent and separate from the original building's wood frame. The additional columns of conventional steel framing while providing the required seismic support, occupy additional space and thus reduce clearance for parking. Their installation frequently requires construction of a new foundation below the supporting columns as well as the connection of the new frame to the existing structure to adequately transfer seismic loads from the building to the new frame. The construction and installation of these added steel structures is time consuming and thus very disruptive, is difficult to install and thus expensive and the result, while workable, is somewhat inefficient.

The frame assembly of the present invention provides the support necessary to comply with the new retrofit ordinances in California while obviating the shortcomings in the current retrofitting practices.

SUMMARY OF THE INVENTION

Briefly, the present invention comprises a steel frame assembly for seismic retrofitting of older soft story buildings that fits about the existing wooden frame, providing the strength and stiffness of the steel moment frames required to prevent collapse in the event of an earthquake. By extending about and hugging the existing wooden columns, the assembly of the present invention provides the needed support without noticeably intruding into the opening about which the frame extends, resulting in a better space utilization for tuck-under parking applications. The attachment of the upstanding column portions of the new frame assembly to the overhead beam portion thereof and to the existing wooden frame also provides a direct and efficient transfer of a seismic load from the building to the new steel frame. In addition, the present invention also reduces costs due to the assembly's ease of installation, the elimination of the need for constructing an extensive new foundation as is often required for the addition of a steel frame adjacent to the wooden frame, a simplified seismic design process and reduced construction times as compared to the design and installation of conventional add on steel frames.

In a preferred embodiment of the present invention, the frame assembly comprises two half frame subassemblies, each formed of a plurality of conventional steel channels, which are joined together and cooperate so as to extend over and about the open area. Each subassembly can comprise two identical quarter frames, one defining the front and adjacent side portions of one of the subassemblies and the other defining the rear and adjacent side portions of the subassembly. Each quarter frame can comprise a steel channel column portion and a steel channel beam portion so that the front and rear column portions of each subassembly can extend about and encase one of the existing vertical wood columns on the soft story line. The front and rear beam portions in each half frame subassembly are carried by and extend laterally from adjacent upper end portions of the two column portions therein in a parallel disposition half-way along the upper end of the opening and are secured together so as to define two parallel beam portions traversing the upper end of the opening in the building on opposed sides of and laterally spaced from the opposed sides of the wooden beam. Alternatively, the front and rear beam portions may each be of single piece construction spanning the steel column portions of the frame assembly s without a mid-span connection.

In one embodiment of the present invention, the extended end portions of the channel beam portions in the frame subassembly can be secured to upper end portions of the adjacent column channel portions from which they extend by means of connector plates. One plate can be secured to an upper end portion of each column portion and another plate can be secured to the outer end portions of each beam portion. The plate on each column portion is aligned with and secured to an adjacent connector plate on a beam portion so as to define a pair of moment connections between the column and beam portions at the upper opposed ends of the frame assembly. Variations in the channel column and beam connections may be employed depending on the design parameters of the building in which the retrofit frame assembly of the present invention is to be employed.

In the above-described embodiments of the present invention, the steel channel beam portions of the new frame assembly are carried by and extend laterally from the upper end portions of the steel channel column portions parallel to and at the same elevation as the wooden beam, preferably the bottom of the wooden beam. This configuration is ideal for soft story buildings having tuck under parking where the headroom for the cars is at a minimum. In those applications where the ceiling and the beam of the wooden frame are higher and provide adequate headroom, the present invention is readily adapted for locating the beam portions of the new frame assembly at an elevation below the wooden beam to provide a stronger frame assembly for the building. In such situations, the connector plates for securing the front and rear beam portions to the column portions are affixed to the column portions of the assembly at an elevation selected by the engineer for the particular application. The steel retrofit frame assembly is otherwise unchanged and the steel channel column portions thereof would continue to extend upwardly about the wooden columns to the underside of the wooden beam so as to encase the entire lengths of the original wooden columns as in the prior embodiments.

BRIEF DESCRIPTION OF THE DRAWINGS

FIG. 8 is a perspective view of the extended end portions of two aligned channel beam portions of the present invention illustrating an attachment therebetween.

FIG. 9A is a perspective view of the extended end portion of a channel column portion with a column connecting plate secured thereto.

FIG. 9B is a perspective view of an end of a channel beam portion of the present invention with a beam connector plate secured thereto.

DETAILED DESCRIPTION OF THE PREFERRED EMBODIMENTS

Referring now in detail to the drawings, the frame assembly 10 of the present invention is particularly designed for seismic retrofitting of soft story buildings 12 and provides structural reinforcement for the portions of the wooden frames 14 that extend about the large openings 16 therein. Frame assembly 10 is specifically designed to cooperate with the column and beam portions 14A and 14B of the existing wood frames 14 to provide the necessary structural support to meet current retrofit requirements and obviate the problems discussed earlier herein that result from the addition of a separate metal frame structure adjacent to the original wooden frame.

Figure 1:
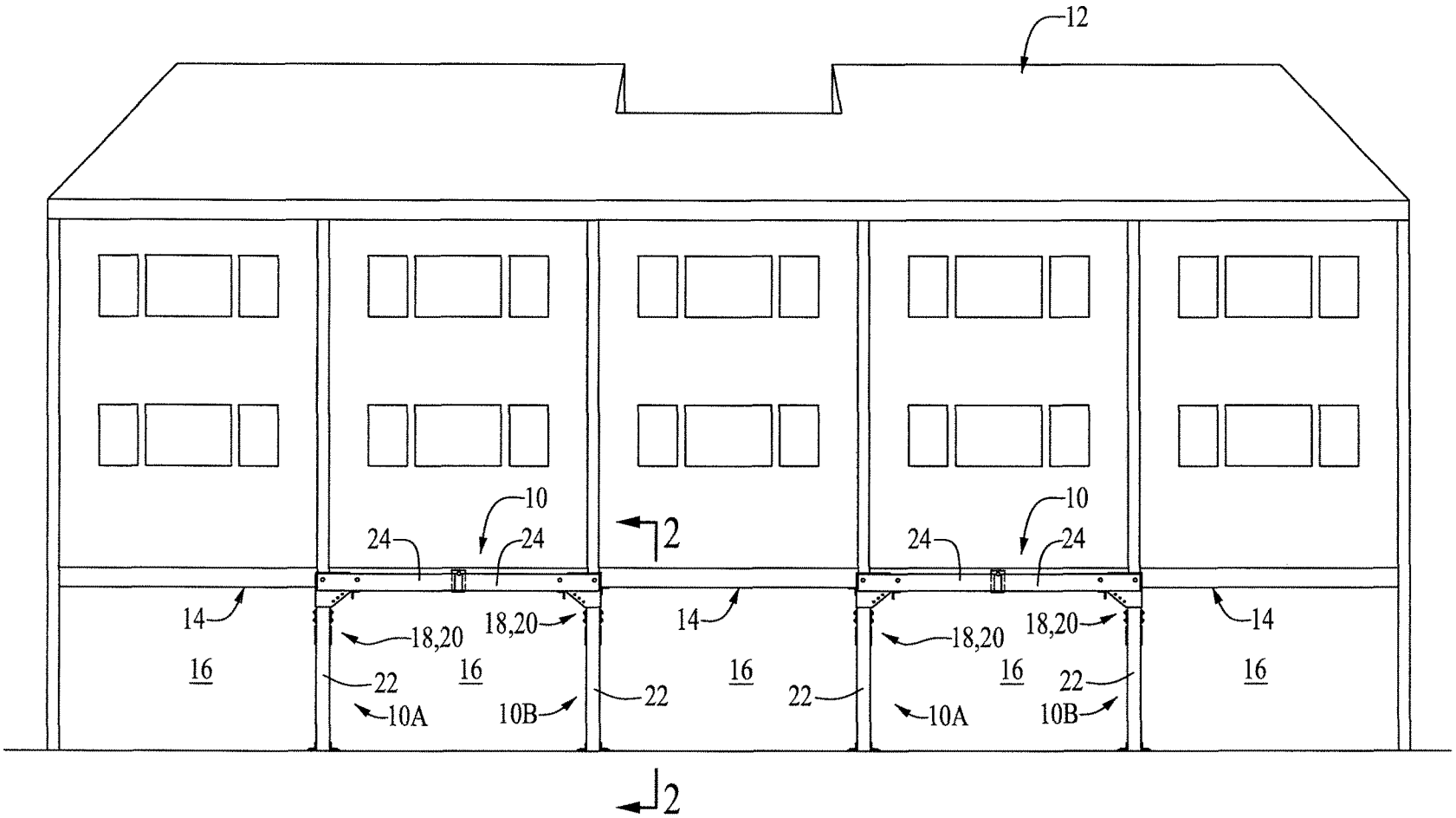
FIG. 1 is a perspective view of a frame assembly of the present invention in place on a retrofitted soft story building.

In the embodiment of the invention illustrated in the drawings, the retrofit frame assembly 10 comprises two half frame subassemblies 10A and 10B which are joined together at their extended ends about opening 16 as will be described. Each subassembly comprises a front section 18 and a rear section 20 (as viewed from outside building 12 looking toward opening 16 as in FIG. 1). The front and rear sections 18 and 20 of the half frames each include a steel column portion 22, a steel beam portion 24 and preferably, a pair of steel connector plates 26 and 28. The steel column and beam portions 22 and 24 are of a conventional C-shaped cross-sectional configuration and thus also are referred to herein as channel column portions and channel beam portions. While conventional channel sections rolled in a steel plant are economical and well suited for forming the column and beam portions of the present invention, other methods of forming generally C-shaped steel sections could be employed.

In frame assembly 10, the web and flanges 24' and 24" of the channel beam portions 24 are larger and stronger than the webs and flanges 22' and 22" defined by the channel column portions 22 in order to locate the plastic flexing of the frame assembly 10 during a seismic disturbance in the columnar portions of the frame 10 as opposed to the overhead beam portion. The actual sizes of the column and beam portions will depend on the size of the existing wooden frame in a particular application as well as the relevant structural parameters of the soft story building to be reinforced, e.g. number of floors, size of the ground floor opening(s) and weight of the structure, and will be determined by the design architect/engineers for each such application. Also, the number of frame assemblies 10 required for a given building will be determined based on the structural design of the building and not all existing wooden columns on a soft story building may require encasement by column portions 22.

Figure 9C:
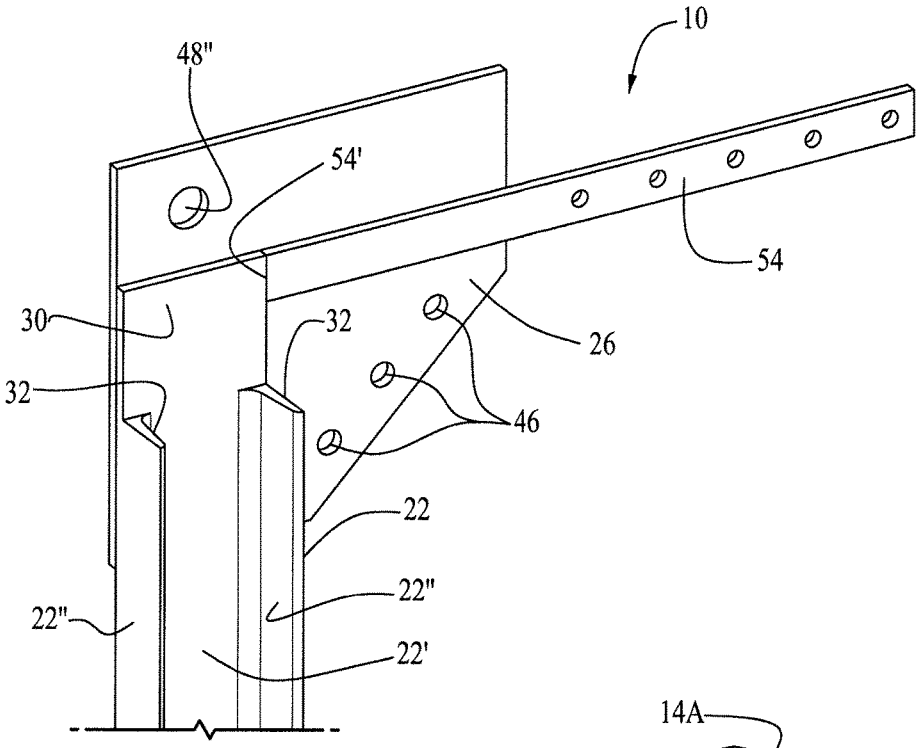
FIG. 9C is a perspective view of the backside of an end portion of a channel column as seen in FIG. 9A.

The individual channel column portions 22 in frame assembly 10 are sized so as to fit about one-half of a wooden column 14A and extend from the lower end of the wooden column 14A to the upper end thereof. The upper end portions of the flanges 22" of the steel channel column portions 22 of frame assembly 10 can be cut away to provide the upper ends of each column portion with an upstanding plate 30 that is positioned adjacent to one of the sides of an extended end portion of the wood beam 14B upon the channel column portion of the frame assembly 10 being positioned thereunder. See FIGS. 2 and 9C.

Figure 2:
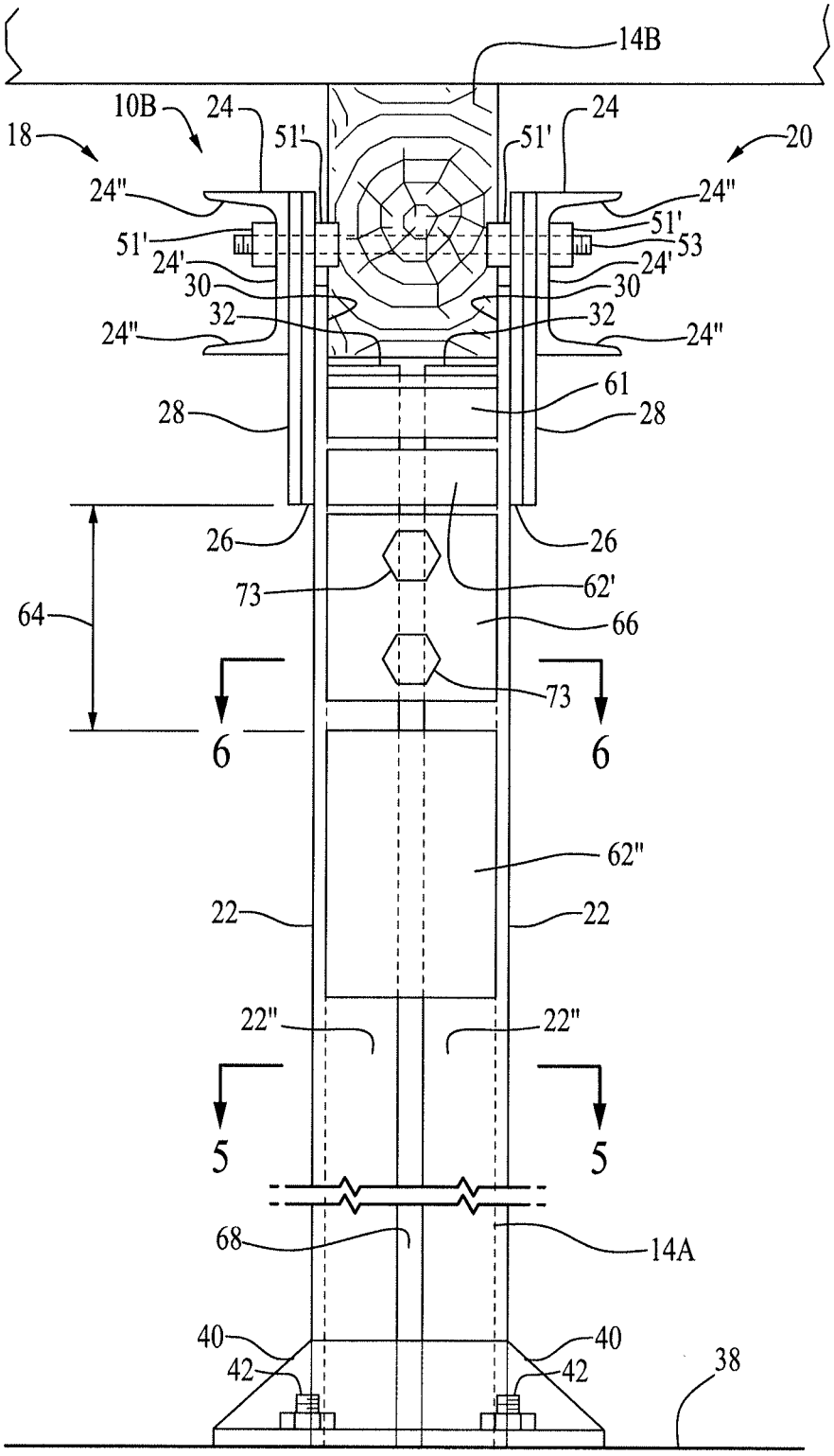
FIG. 2 is an enlarged side view of a frame assembly of the present invention in place about an original wooden frame structure of a soft story building.
Figure 5:
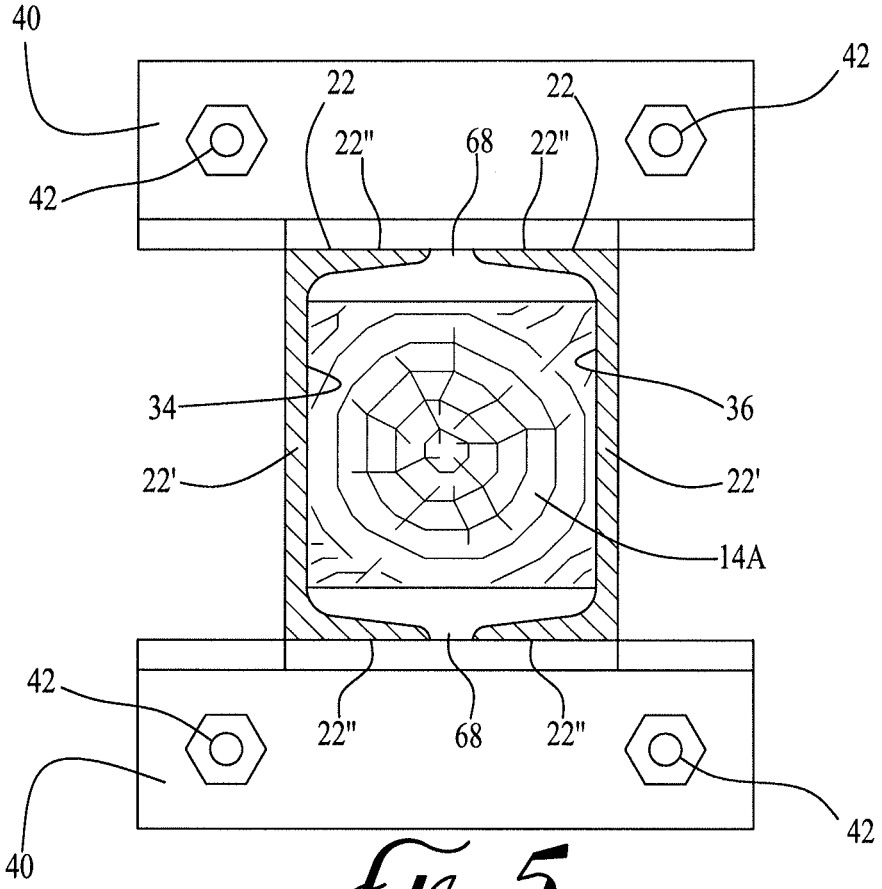
FIG. 5 is a sectional view taken along the line 5-5 of FIG. 2.
Figure 10:
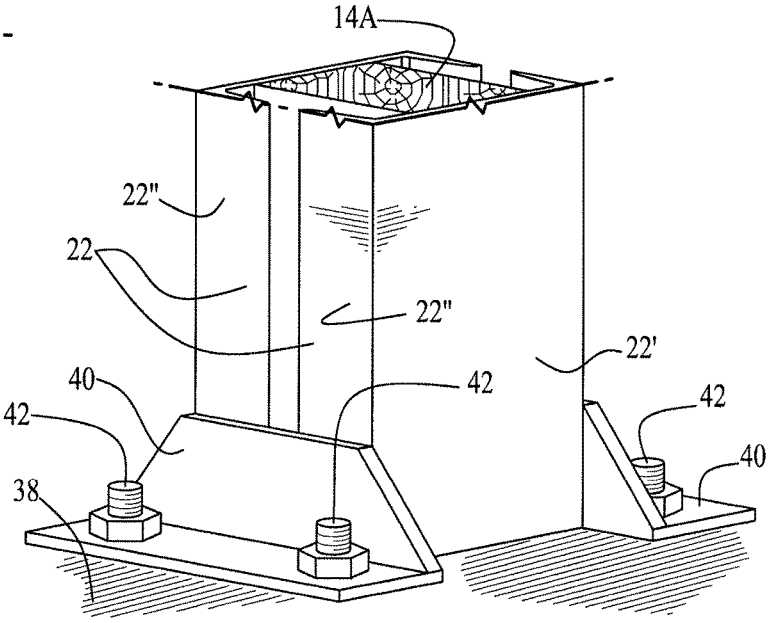
FIG. 10 is a perspective view of the lower end of the channel column of FIG. 9A showing the base footing secured to the foundation.

Upon positioning the steel channel column portions 22 of the front and rear frame sections 18 and 20 about an exposed wooden column portion 14A of the original frame 14, the lower ends of the column portions 22 are adjacent to the lower ends of the original wooden columns and rest on or buried in the existing foundation 38. The inner surfaces 34 and 36 of the web 22' and flanges 22" defined by each of the column portions 22 are proximate to the outer surfaces of the upstanding wood columns 14A with the web portions 22' of the column portions being disposed about the front and back sides of the wooden columns 14A and the flange portions 22" being in opposed juxtaposition and extending about the interior and exterior sides of the wood columns (see FIG. 5). Also, the upstanding plates 30 on the upper ends of the channel column portions 22 of the frame assembly 10 are adjacent to the sides of the wooden beam 14B as above described and the upper ends 32 of the flange portions 22' on the opposed column portions are in substantial planar alignment and below the underside of the wood beam 14B as shown in FIG. 2. Suitable bases 40 can be provided at the lower ends of the adjacent column portions 22 to form a footing for the new frame assembly 10 that can be secured to the existing foundation 38 by means of suitable anchors 42. Preferably the column bases 40 should extend across and be welded to the aligned lower ends of the flange portions of the column portions as shown in FIG. 10.

To secure the channel beam portions 24 of the frame assembly 10 to the channel column portions 22, a rigid steel connector plate 26 can be suitably affixed to the outer surface of the web portion 22' of each of the column portions 22, preferably welded in a steel fabrication facility. A substantially identical plate 28 can be similarly affixed to the end portions of each of the beam portions 24 of the frame assembly as seen in FIGS. 9A and 9B. Upon securing the column portions 22 about the column portions 14A of the original wooden frame as above described, the beam portions 24 are attached. The plates 28 on the beam portions are aligned in adjacent juxtaposition with plates 26 on the column portions and secured thereto. So secured, the beam portions 24 of frame assembly 10 project from the column portion 22 and extend parallel to and on opposed sides of the wooden beam 14B.

To secure the connector plates 26 on the channel column portions 22 of the frame assembly 10 to the plates 28 on the channel beam portions 24 thereof, the connector plates 26 and 28 preferably are provided with a plurality of mounting apertures extending therethrough. In the illustrated pattern, three apertures 46 are provided in the lower forward portion of the plates for receiving suitably sized fasteners 47, preferably nut and bolt type, for securing together the pairs of plates 26 and 28 in adjacent juxtaposition.

For those applications where the headroom under the beam of the wooden frame is an issue, the connector plates 26 can be secured to the column portions 22 of the frame assembly at the upper ends thereof such that the pairs of plates 26 and 28 secured together would be positioned at each of the upper corners of the frame assembly 10. So positioned, the beam portions 24 of the frame assembly can extend horizontally from the column portions 22 at substantially the same elevation as the wooden beam and preferably no lower than the bottom of the wooden frame so as not to impinge on the headroom afforded by the openings 16 in the soft story buildings.

Figure 4:
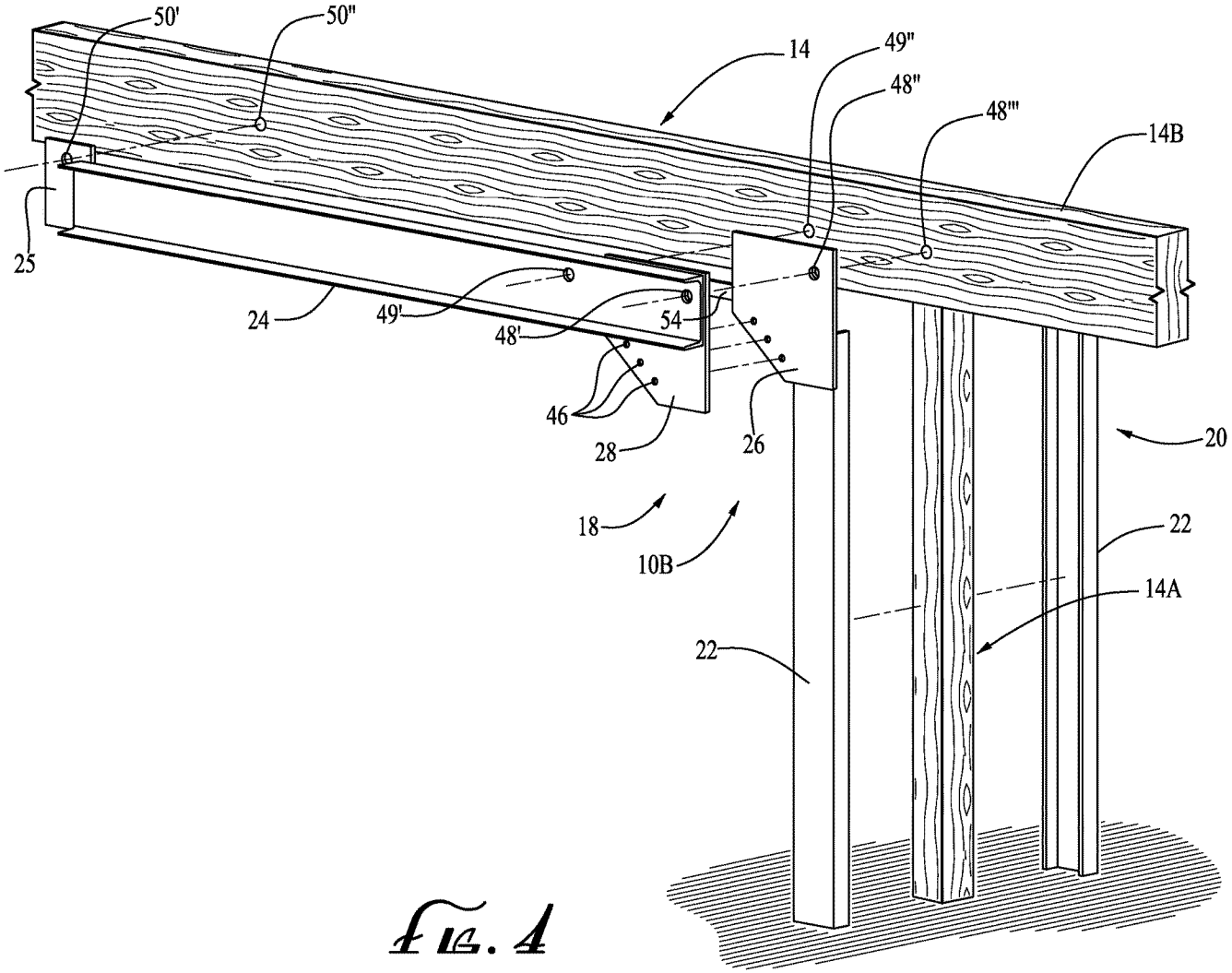
FIG. 4 is an exploded perspective view of portions of a half frame subassembly of the present invention and of the original wooden frame of a soft story building.
Figure 7:
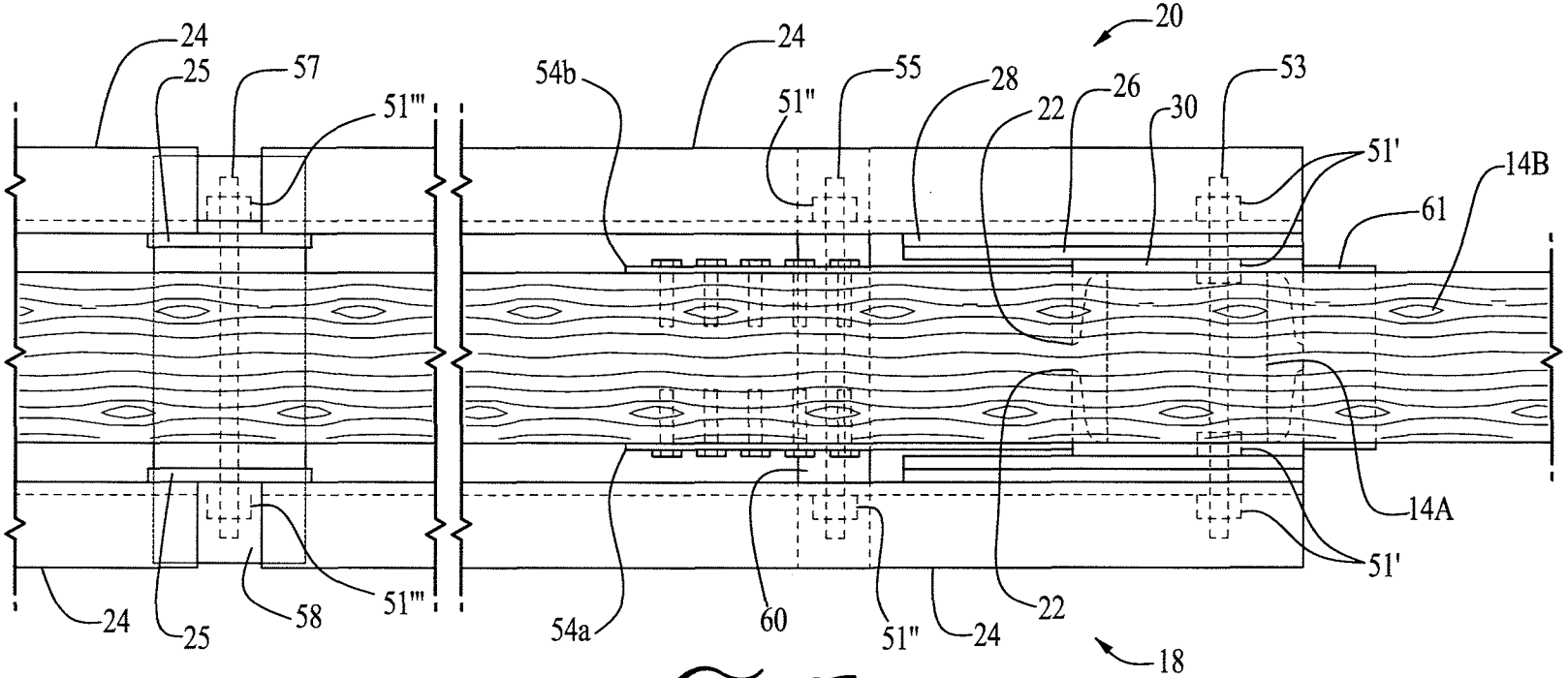
FIG. 7 is an enlarged plan view of a half frame subassembly of the present invention in place about an original wood frame structure of a soft story building.

To secure the front and rear beam portions 24 of each subassembly 10A and 10B to each other and to the wooden beam 14B, larger (relative to apertures 46) and identically spaced apertures can be provided in the extended end portions of the steel beam portions 24, in the upper portions of the connector plates 28 and 26, in the attachment plates 25 used to secure together the extended ends of the aligned front and rear beam portions of the two half frame subassemblies, and in the wooden beam 14B proximate each end thereof and in a center portion of beam 14B adjacent to the attachment plates 25 (see e.g., FIGS. 4 and 7). Preferably, apertures 48', 48" and 48'" extend in axial alignment through extended end portions of the front and rear steel beam portions 24, the connector plates 28 and 26 and the wooden beam 14B. Apertures 49' and 49" are inwardly spaced from apertures 48' and 48'" and extend in axial alignment through the front and rear steel beam portions 24 and the portion of the wooden beam disposed therebetween and apertures 50' and 50" extend through the aligned attachment plates 25 on the inwardly extended end portions of the front and rear steel beam portions and through the wooden beam as illustrated in FIG. 4. Elongated fastening members, preferably threaded rods 53, 55 and 57 extend through the axially aligned apertures in the beam portions, the adjacent plates in each half frame subassembly and through the wooden beam 14B of the original frame 14. Nuts 51', 51" and 51'" threadably engage end portions of the rods 53, 55 and 57 respectively to effect the desired securement. Preferably, nuts 51' threadably engage threaded rod 53 on both sides of each adjacent pair of connector plates to provide both tension and compression resistance (see e.g., FIG. 7). Note that the inner two nuts 51' on rod 53 that are adjacent to the wooden beam 14 may need to be embedded somewhat into the beam as illustrated in FIG. 2, depending on available space. As is also seen in, for example, FIG. 7, threaded rod 55 is threadably engaged by threaded nuts 51" adjacent the outer surfaces of the channel beam 24 and threaded nuts 51'" engage rod 57 adjacent the outer surfaces of the attachment plates 25 between the extended ends of the aligned beam portions. After fabrication, nuts 51" can be welded to the beam portions of the frame assembly on the outer surfaces of the web portions thereof and nuts 51'" can be welded to the outer surfaces of the attachment plates 25 of the front and rear beam portions. A steel plate 58 can be welded to and extend between the two attachment plates 25 under the wooden beam 14B. The above described connections enhance the securement of the connector plates 26 and 28 to both the column and beam portions of the frame assembly and of the new frame assembly 10 to the original wood frame 14, providing strong and durable moment connections therebetween and inhibiting twisting of the beam portions of the frame assembly during a seismic disturbance.

Figure 11:
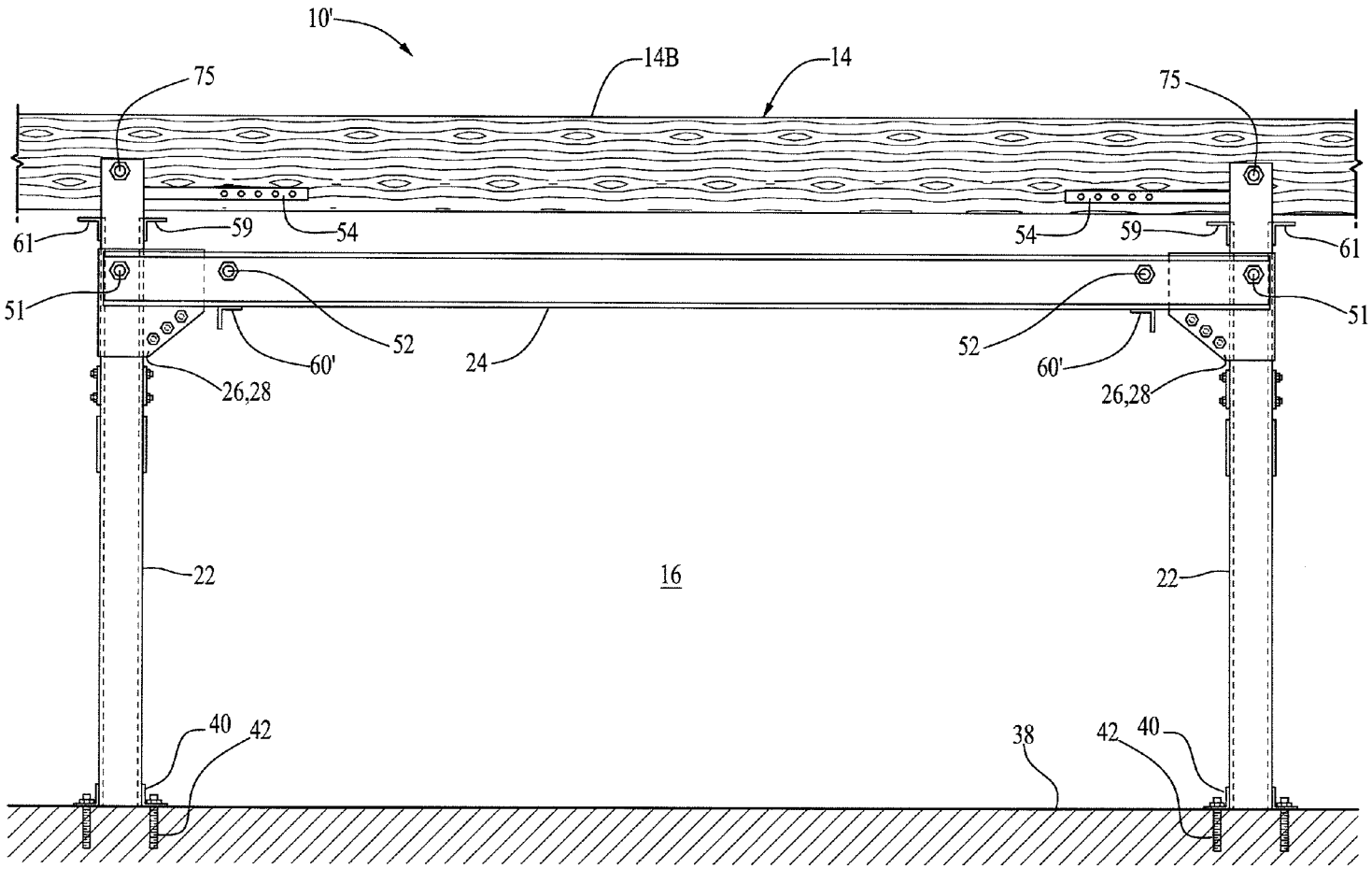
FIG. 11 is a perspective view of an alternate embodiment of the present invention for soft story buildings having tall wooden frame columns and illustrating a use of front and rear channel beam portions of single piece construction.

The channel beam portions 24 of each half frame subassembly 10A and 10B are of sufficient length to extend to a midpoint of the original wooden beam 14 and the extended ends of the beam portions in one of the half frame subassemblies 10A or 10B can be provided with a steel attachment plate 25 which, when welded to the end of the aligned beam portions in the other half frame subassembly, interconnects the two half frame subassemblies above the midpoint of the soft story opening 16. It is to be understood that other attachment configurations could be employed to interconnect the aligned front and rear beam portions of the two subassemblies. While the channel beam portions of the two subassemblies may be of a single piece construction and extend between the column portions of the metal frame assembly without a mid-span connection, such as attachment plates 25 (see FIG. 11), the subassembly configuration 10A and 10B of the preferred embodiment is lighter than the single piece configuration embodiment and thus is easier to install. Also, the attachment plates 25 by which the extended ends of the beam portions in the two subassemblies are secured together allow for some adjustment in the length of the steel beam portions of the frame assembly to fit the wooden beam. Single piece front and rear beam portions spanning the columns would be of a fixed length, requiring tighter tolerances. It is to be understood that other suitable connectors could be employed in lieu of flat attachment plates 25 to effect securement of the beam portions.

In an alternate configuration of the moment connections in the present invention that secure the channel column and beam portions of the frame assembly together and to the wooden beam of a soft story building, only two connector plates could be employed at each corner of the frame assembly. A single connector plate could be disposed between and welded to both the front column and beam portions and a second plate disposed between and welded to the rear column and beam portions. Each such plate would be welded to both a column and beam portion, obviating the need for the apertures 46 and fasteners 47 used to secure the pairs of plates 26 and 28 together. Elongated fastening members such as fastening members 53-57 described above with respect to the preferred embodiment could still be employed to extend through the column and beam portions and depending on the elevation of the beam portions 24 relative to the wooden beam, the fastening members could extend through the wooden beam as well. In retrofitting structures with less demands, the connector plates might be eliminated altogether and the channel beam portions welded directly to the channel column portions. For most soft story buildings, however, it is believed that the above described dual plate system with one plate 26 being secured to each column portion and a second plate 28 to each adjacent beam portion would be preferred.

The load of a soft story building 12 retrofitted with frame assembly 10 under normal conditions is carried by the beam 14B and column 14A of the original wooden frame. To transfer the seismic load of the building during an earthquake from the wooden beam directly to the new frame assembly, at least one durable connector 54 such as a metal tie strap, like those manufactured by Simpson Strong-Tie of Urbana, Iowa, can be positioned adjacent to the underside of the wood beam 14B proximate each end thereof so that the outer end of each strap can be welded to the adjacent column portion 22 and the body of the straps secured to the underside of the adjacent wood beam with a plurality of wood screws extending through the apertures provided in the tie strap. While fastening members 53-57 may extend through the wooden beam when the beam portions 24 of the frame assembly 10 are at the same elevation to avoid a loss of headroom under the wooden beam, the primary functions of fastening members 53-57 is to secure together the metal portions of the frame assembly 10 and to inhibit twisting of the beam portions 24 relative to the wooden beam during a seismic condition (earthquake). A more durable connection of the new frame assembly 10 to the wooden frame 14 is preferred to transfer the seismic load of the building to frame 10 during an earthquake. While a plurality of large durable bolts or other suitable connectors might be used in lieu of a single tie strap 54, more preferably, two such tie straps 54*a* and 54*b* are utilized in each half frame subassembly with one strap extending along and being secured to each side of the wood beam with suitable wood screws and the outer end portions 54' of the tie straps 54 being welded to the adjacent upper end portions of the column portions 22 of the frame assembly 10. See FIGS. 7 and 9C.

Figure 3:
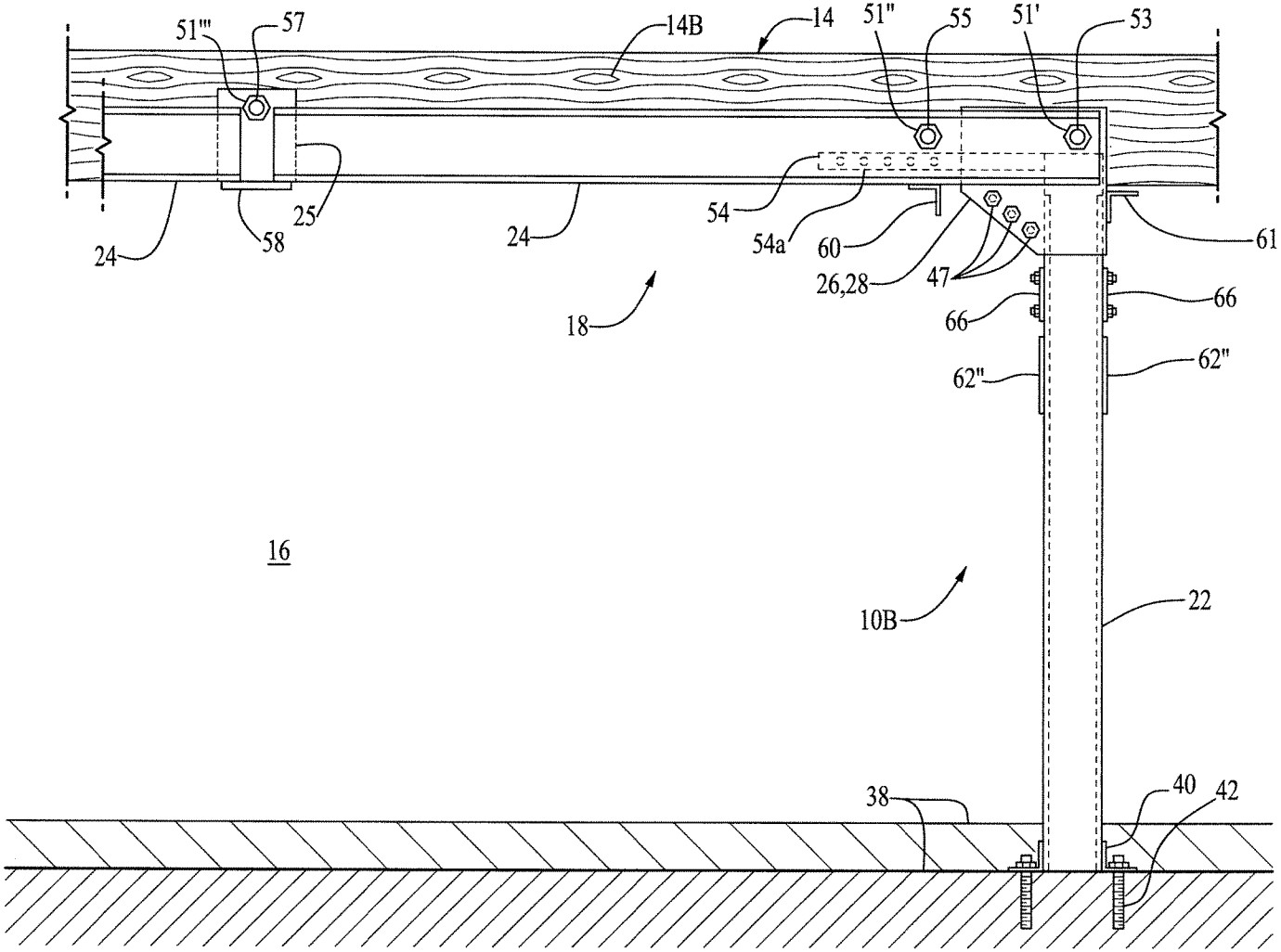
FIG. 3 is an enlarged front view of a half frame subassembly of the present invention in place about an original wooden frame structure of a soft story building.

To counter the upward tension forces acting on and tending to lift up the column portions 22 of the frame during an earthquake which are generated by the lateral forces being exerted on the wood beam 14B, anchors 42 extend through the column bases 40 welded to the lower ends of the column portions and into the existing foundation 38. More preferably, however, to resist uplift, a transversely extending angle plate 60 can be welded onto the undersides of the beam portions 24 of each half frame subassembly so as to extend therebetween slightly below the underside of the wooden beam 14B. By inserting shims (not shown) tightly between the angle plate 60 and wood beam 14B, the gravity load from the beam is directly transferred to the beam portions 24 of the new frame assembly, inhibiting the columnar uplifting. To pick up the load on the outsides of the frame assembly during an earthquake, a steel angle plate 61 can be added to each corner of the steel frame assembly. Each such plate abuts and is welded to the adjacent upper outer flange surfaces of the two column portions in each half frame subassembly and abuts but is not affixed to an adjacent underside of the wood beam 14B as seen in FIG. 3. In the event, the portion of an angle plate that is adjacent to the underside of the wood beam does not actually abut the underside of the beam, shims (not shown) could be inserted between the beam and the plate, further inhibiting any lifting of the frame assembly.

In the present invention, it is preferable to have the new steel building frame undergo plastic flexing in the columnar portions during an earthquake as opposed to the beam portions. It is also desirable to locate the positioning of the flex to predetermined areas proximate the beam portions of the frame. These objectives are accomplished by making the channel beam portions 24 of the frame assembly 10 larger and thus stronger than the channel column portions 22 and through the use of pairs of vertically spaced reinforcement or cover plates 62' and 62" which are welded to the opposed sides of the column portions 22 of the frame assembly over the flanges 22' thereon. See, e.g., FIG. 2. The addition of the vertically spaced cover plates creates a slightly weaker area in the column portions of the frame so as to define a plastic hinge zone 64 between the upper and lower cover plates 62' and 62", thereby isolating the portions of the frame that would flex plastically during an earthquake. By thus defining the location and length of this plastic hinge zone, a ductile behavior is obtained and the computation of the seismic design parameters of the frame assembly components is facilitated.

Figure 6:
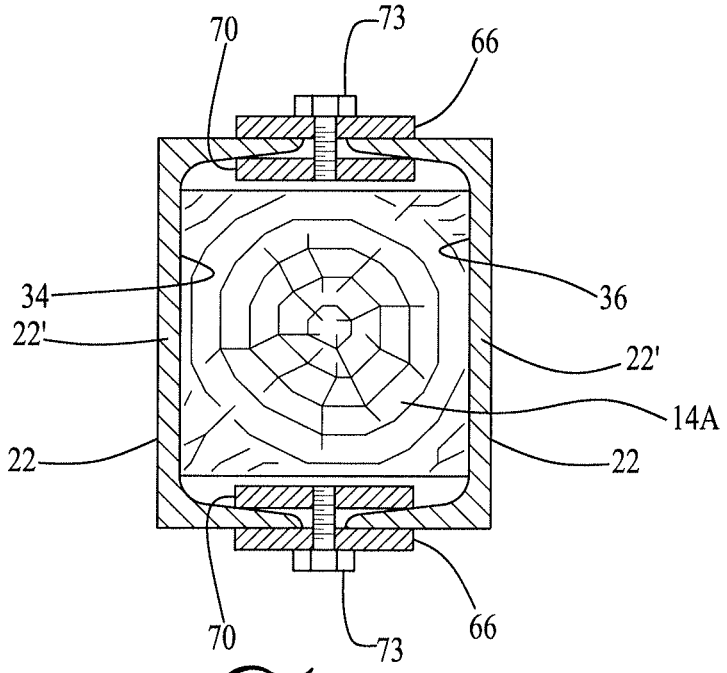
FIG. 6 is a sectional view taken along the line 6-6 in FIG. 2.

While controlled bending during a seismic disturbance is desirable, any buckling of the columnar portions is not. Thus, the cover plates 62' and 62" are provided over the flanges on the adjacent channel column portions of the frame because the free ends of the individual flanges on the column portions are far more prone to buckling than the web portions thereof. To further ensure against any buckling during an earthquake, smaller restraining plates 66 can be provided over portions of the flanges in the plastic hinge zones. The restraining plates are preferably slidably mounted for movement along the plastic hinge zones 64. By sizing the channel column portions 22 of the frame assembly 10 relative to the original wooden columns so as to leave at least a gap 68 between the extended ends of the opposing flanges 22" in each of the half frame subassemblies and a spacing between the surfaces of the wooden columns 14A and the surrounding interior surfaces of the flange portions of the steel channel column portions 22, slidable interior plates 70 can be provided in the spacings between the wooden column and metal flanges and affixed to the outer restraining plates 66 by a suitable fastening members 73 extending between the plates 66 and 70 through the gaps 68 between the ends of the opposed flanges. See FIG. 6. For the purpose of economy, if a standard column size does not provide a gap 68 of sufficient size to accommodate fastening members 73, the free ends of the flanges 22" within the plastic zone may be cut away to provide the required gap size.

In the embodiments of the present invention described above, the steel channel beam portions of the frame assembly were described as being carried by and extending laterally from the upper end portions of the steel channel column portions so as to extend parallel to and laterally spaced from the opposed sides of the wooden beam, preferably at about the same elevation as the bottom of the wooden beam so as not to impinge on the headroom afforded by the new frame assembly 10. However, positioning the beam portions of the frame assembly 10 at the same elevation as the wooden beam would be inefficient in those applications where the column portions of the wooden frame are relatively tall. When headroom for the cars is not an issue, the frame assembly is stronger when the beam is in a lower position. The frame assembly 10 of the present invention is readily adaptable for both applications.

Figure 12:
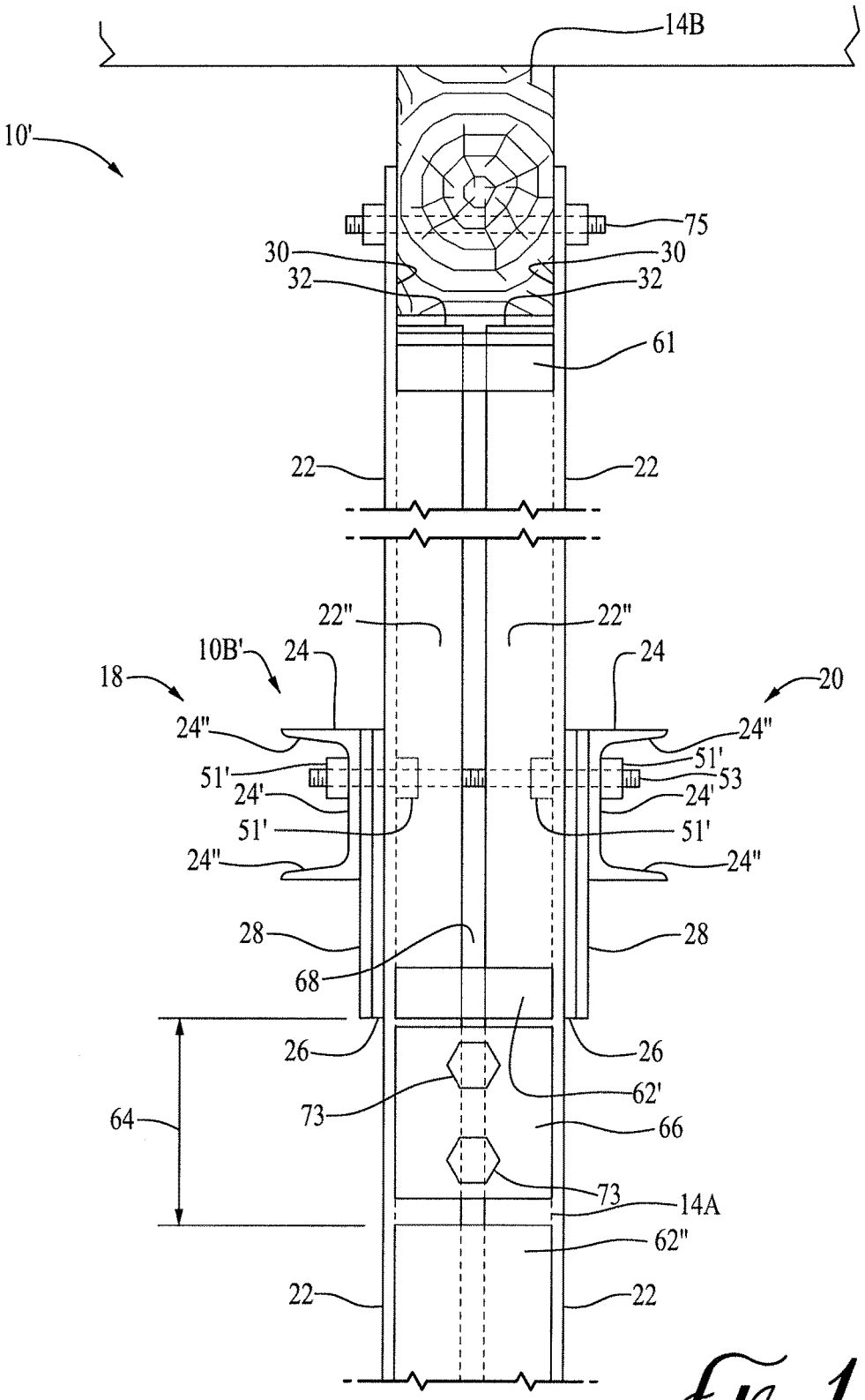
FIG. 12 is an enlarged side view of the frame assembly of FIG. 11 in place about an original tall wooden frame of a soft story building.
Figure 13:
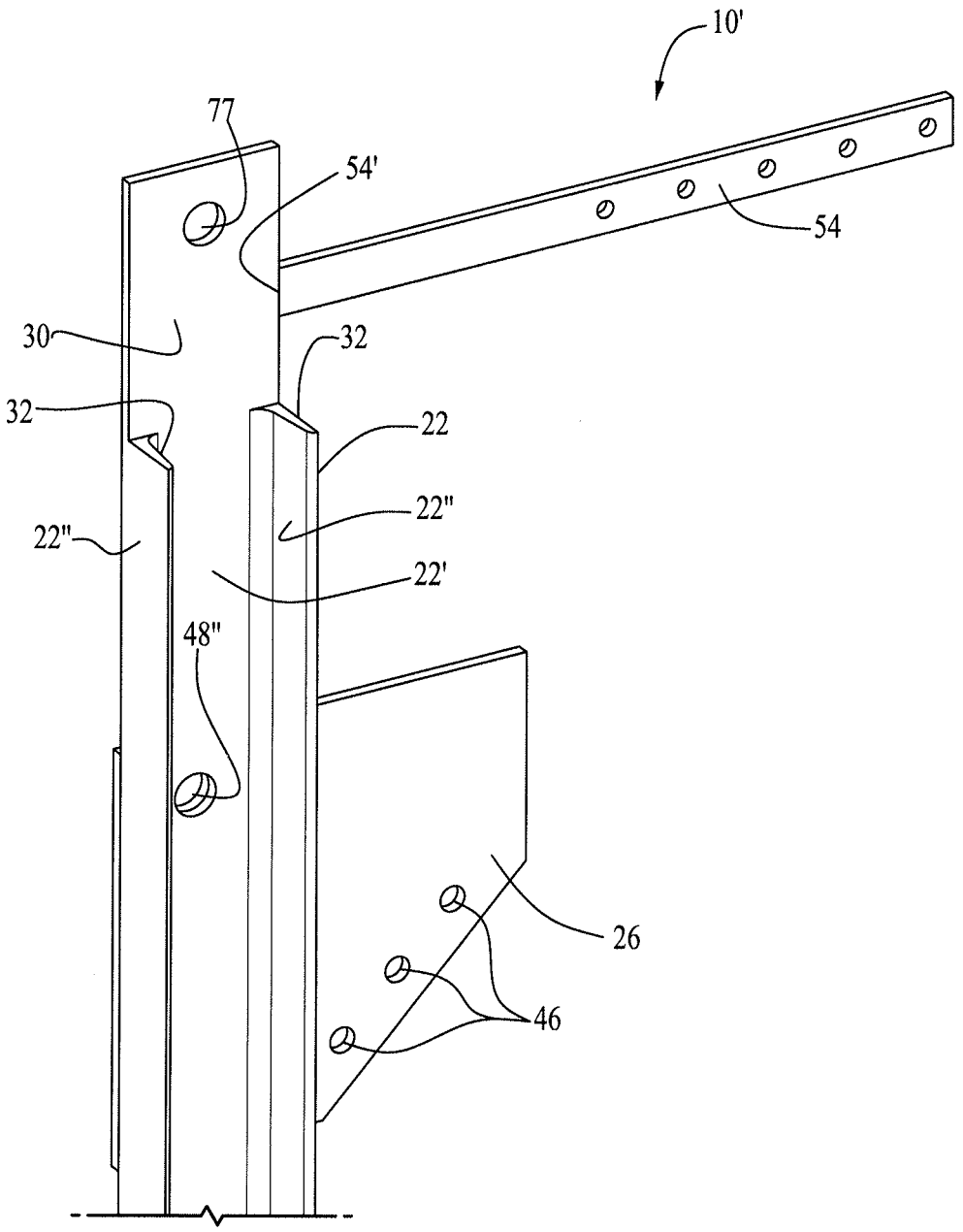
FIG. 13 is a perspective view of the backside of an end portion of a channel column portion of the assembly of FIGS. 11 and 12.

In soft story buildings having tall wooden columns, the front and rear channel column portions 22 are identical in configuration to the shorter column portions of the prior embodiments and again encase the full length of the wooden frame columns. The upper end portions of the longer column portions of the steel frame assembly again preferably, but not necessarily, define upstanding plates 30 that are positioned vertically adjacent to the opposed sides of the wooden beam as previously described. The connector plates 26, however, are not affixed to the column portions at the upper ends thereof, but at a lower elevation that is determined by the engineer for the particular project (see FIG. 12). For example, such a position might only be about two-thirds of the way up the column portions but it will vary from job to job depending on the physical characteristics of the particular application.

In the taller frame assembly 10', the connector plates 28 are again attached to the extended end portions of the beam portions 24 of the assembly as discussed previously and attached to the column portions via connector plates 26 as previously described. Preferably, additional fastening members 75 would extend through apertures 77 in the upstanding plates 30 at the upper ends of the column portions and through apertures (not shown) in the portions of the wooden beam between plates 30 to secure the frame assembly to the wooden beam. Also, while angle plates 60' and 61' in the taller frame assembly 10' are positioned as are angle plates 60 and 61 in frame assembly 10, angle plates 61' are at an elevated position on the column portions with respect to angle plates 61. Additional angle plates 59 preferably are added to the taller assembly 10' on opposed sides of the column portions from angle plates 61 (see FIG. 11). Thus, the primary difference between a frame assembly 10' for tall column installations and the frame assembly 10 previously described is the elevational positioning of the connector plates 26 on the column portions of the frame assembly which determines elevation of the beam portions 24 of the frame assembly relative to the beam of the wooden frame.

As noted earlier herein, the frame assembly 10 of the present invention preferably comprises conventional C-shaped steel channel configurations and sizes, the particular dimensions of which will be determined by the design architect(s)/engineer(s) for each application as noted earlier herein. As such, the spacing between the various portions of the original wood frame and the proximate components of the steel frame assembly 10 will vary, not only to meet different structural requirements but also to accommodate variations in the size of the wooden frames with which the present invention is employed. The configuration of the frame assembly 10 also accommodates variations in those spacings. While the web portions of the column portions 22 of the present invention are illustrated as being in abutment with the wooden columns, this frequently may not be the case due to irregularities in the size of the wooden columns and the economic advantages of using standard steel channel sections to substantially encase the wooden columns. In addition, because the frame assembly of the present invention encases the column portions of the original frame of the soft story building and does not penetrate the original columnar portions of the building frame, the present invention is ideally suited for seismic retrofitting of those soft story buildings having steel tubular columns as well as wooden columns.

Various changes and modifications can be made in carrying out the present invention without departing from the spirit and scope thereof. Insofar as these changes and modifications are within the purview of the appended claims, they are to be considered as part of the present invention.

What is claimed is:

1. A metal frame assembly for seismic retrofitting of soft story buildings having a large opening on the ground floor thereof and a wooden frame disposed about the opening comprised of a pair of laterally spaced upstanding columns and a wooden beam extending horizontally therebetween over the opening, said metal frame assembly comprising:

a pair of half frame subassemblies, each subassembly being adapted to be secured to a wooden beam in a soft story building whereby the load of the building is transferred to the metal frame assembly during seismic conditions and wherein such subassembly comprises front and rear steel channel column portions and front and rear steel channel beam portions;

said front and rear column portions in each subassembly being configured to extend about and substantially encase a column of a wooden frame in a soft story building;

said front and rear beam portions in each subassembly being secured to and carried by upper portions of said column portions in each said subassembly such that with said front and rear column portions being secured about the upstanding columns of the wooden frame, said beam portions extend horizontally from said column portions and parallel to the wooden beam;

a plurality of steel connector plates in each of said subassemblies securing together the front beam portion to the front column portion and the rear beam portion to the rear column portion;

at least two steel connecting members, one of said members being secured to an extended end portion of one of said front beam portions and another of said members being secured to an extended end portion of one of said rear beam portions for securement of the front and rear beam portions of one subassembly in axial alignment with the front and rear beam portions of another subassembly;

at least one attachment member in each subassembly secured to and extending between each said subassembly and a wooden frame in a soft story building whereby the load of the building is transferred to the metal frame assembly during a seismic condition; and a plastic hinge zone in the front and rear column portions of each said subassembly below and proximate said connector plates whereby flexing of said metal frame assembly in said plastic hinge zones during an earthquake is facilitated.

2. The metal frame assembly of claim 1 wherein said at least one attachment member comprises at least one metal strap secured to and extending between the beam of a wooden frame and said column portions of the metal frame assembly.

3. The metal frame assembly of claim 1 wherein each subassembly comprises a first connector plate welded to an extended end of the front beam portion and to an upper portion of the front column portion and a second connector plate welded to an extended end of the rear beam portion and an upper portion of the rear column portion and a pair of axially spaced fastening members extending through said front beam portion, said first connector plate, said front column portion, the wooden beam, the rear column portion, said second connector plate and said rear beam portion whereby said beam and column portions in said subassembly are secured together and to the wooden beam of a soft story building and said beam portions of said frame assembly are inhibited from twisting relative to said column portions during a seismic condition.

4. The metal frame assembly of claim 3 wherein said at least one attachment member comprises at least one metal strap secured to and extending between the beam of a wooden frame and said column portions of the metal frame assembly.

5. The metal frame assembly of claim 3 wherein each column portion defines an upstanding plate projecting from an upper end thereof such that upon said front and rear column portions in each subassembly being secured about the upstanding columns on the wood frame, said upstanding plates are disposed proximate opposed sides of the wooden beam and including a first metal strap in each subassembly secured to and extending between the beam of the wooden frame and the upstanding plate on the front column portion of the subassembly and a second metal strap secured to and extending between the beam of the wooden frame and the upstanding plate on the rear column portion of the subassembly.

6. A metal frame assembly for seismic retrofitting of soft story buildings having a large opening on the ground floor thereof and a wooden frame disposed about the opening comprised of a pair of laterally spaced upstanding columns and a wooden beam extending horizontally therebetween over the opening, said metal frame assembly comprising:

a pair of half frame subassemblies, each subassembly being adapted to be secured to a wooden beam in a soft story building whereby the load of the building is transferred to the metal frame assembly during seismic conditions and wherein such subassembly comprises front and rear steel channel column portions and front and rear steel channel beam portions;

said front and rear column portions in each subassembly being configured to extend about and substantially encase a column of a wooden frame in a soft story building;

said front and rear beam portions in each subassembly being secured to and carried by upper portions of said column portions in each said subassembly such that with said front and rear column portions being secured about the upstanding columns of the wooden frame, said beam portions extend horizontally from said column portions and parallel to the wooden beam;

a plurality of steel connector plates in each of said subassemblies securing together the front beam portion to the front column portion and the rear beam portion to the rear column portion;

at least two steel connecting members, one of said members being secured to an extended end portion of one of said front beam portions and another of said members being secured to an extended end portion of one of said rear beam portions for securement of the front and rear beam portions of one subassembly in axial alignment with the front and rear beam portions of another subassembly;

at least one attachment member in each subassembly secured to and extending between each said subassembly and a wooden frame in a soft story building whereby the load of the building is transferred to the metal frame assembly during a seismic condition; and wherein each said subassembly comprises a first of said connector plates welded to an extended end of the front beam portion, a second of said connector plates welded to an upper portion of the front column portion, a third of said connector plates welded to the rear beam portion and a fourth of said connector plates welded to an upper portion of the rear column portion, said first and second connector plates being secured together in adjacent juxtaposition between said front beam and column portions, said third and fourth connector plates being secured together in adjacent juxtaposition between said rear beam and column portions and a pair of axially spaced fastening members extending through said front beam portion, said first and second connector plates, said front column portion, said rear column portion, said third and fourth connector plates and said rear beam portion whereby said beam and column portions in such a subassembly are secured together and to the wooden beam of a soft story building and said beam portions of said frame assembly are inhibited from twisting relative to said column portions during a seismic condition.

7. The metal frame assembly of claim 6 wherein said first and second connector plates are secured together in adjacent juxtaposition below the wooden beam on a front side thereof by a first plurality of threaded fastening members and said third and fourth connector plates are secured together in adjacent juxtaposition below the wooden beam on the rear side thereof by a second plurality of threaded fastening members.

8. The metal frame assembly of claim 6 wherein said at least one attachment member comprises at least one metal strap secured to and extending between the beam of a wooden frame and said column portions of the metal frame assembly.

9. The metal frame assembly of claim 6 wherein each column portion defines an upstanding plate projecting from an upper end thereof such that upon said front and rear column portions in each subassembly being secured about the upstanding columns on the wood frame, said upstanding plates are disposed proximate opposed sides of the wooden beam and wherein said at least one attachment member comprises a first metal strap in each subassembly secured to and extending between the beam of the wooden frame and the upstanding plate on the front column portion of the subassembly and a second metal strap secured to and extending between the beam of the wooden frame and the upstanding plate on the rear column portion of the subassembly.

10. The metal frame assembly of claim 6 including a pair of cover plates welded to opposed sides of and spanning the front and rear column portions in each of said subassembly, said plates being disposed below and vertically spaced from said connector plates so as to define a plastic hinge zone in an upper portion of said column portions of said frame assembly between said connector plates and said cover plates.

11. A metal frame assembly for seismic retrofitting of soft story buildings having a large opening on the ground floor thereof and a wooden frame disposed about the opening comprised of a pair of laterally spaced upstanding columns and a wooden beam extending horizontally therebetween over the opening, said metal frame assembly comprising:

a pair of half frame subassemblies, each subassembly being adapted to be secured to a wooden beam in a soft story building whereby the load of the building is transferred to the metal frame assembly during seismic conditions and wherein such subassembly comprises front and rear steel channel column portions and front and rear steel channel beam portions;

said front and rear column portions in each subassembly being configured to extend about and substantially encase a column of a wooden frame in a soft story building;

said front and rear beam portions in each subassembly being secured to and carried by upper portions of said column portions in each said subassembly such that with said front and rear column portions being secured about the upstanding columns of the wooden frame, said beam portions extend horizontally from said column portions and parallel to the wooden beam;

a plurality of steel connector plates in each of said subassemblies securing together the front beam portion to the front column portion and the rear beam portion to the rear column portion;

at least two steel connecting members, one of said members being secured to an extended end portion of one of said front beam portions and another of said members being secured to an extended end portion of one of said rear beam portions for securement of the front and rear beam portions of one subassembly in axial alignment with the front and rear beam portions of another subassembly;

at least one attachment member in each subassembly secured to and extending between each said subassembly and a wooden frame in a soft story building whereby the load of the building is transferred to the metal frame assembly during a seismic condition; and a pair of cover plates welded to opposed sides of and spanning the front and rear column portions in each said subassembly, said plates being disposed below and vertically spaced from said connector plates so as to define a plastic hinge zone in an upper portion of said column portions of said frame assembly between said cover plates.

12. The metal frame assembly of claim 11 wherein said at least one attachment member comprises at least one metal strap secured to and extending between the beam of a wooden frame and said column portions of the metal frame assembly.

13. A metal frame assembly for seismic retrofitting of soft story buildings having a large opening on the ground floor thereof and a wooden frame disposed about the opening comprised of a pair of laterally spaced upstanding columns and a wooden beam extending horizontally therebetween over the opening, said metal frame assembly comprising:

a pair of half frame subassemblies, each subassembly being adapted to be secured to a wooden beam in a soft story building whereby the load of the building is transferred to the metal frame assembly during seismic conditions and wherein such subassembly comprises front and rear steel channel column portions and front and rear steel channel beam portions;

said front and rear column portions in each subassembly being configured to extend about and substantially encase a column of a wooden frame in a soft story building wherein each of said front and rear column portions defines a pair of spaced flanges and a web extending therebetween such that upon said front and rear column portions being secured about the upstanding columns of a wooden frame, said flanges on said front and rear column portions in each of said subassemblies are in opposed alignment about portions of the wooden column;

said front and rear beam portions in each subassembly being secured to and carried by upper portions of said column portions in each said subassembly such that with said front and rear column portions being secured about the upstanding columns of the wooden frame, said beam portions extend horizontally from said column portions and parallel to the wooden beam;

a plurality of steel connector plates in each of said subassemblies securing together the front beam portion to the front column portion and the rear beam portion to the rear column portion;

at least two steel connecting members, one of said members being secured to an extended end portion of one of said front beam portions and another of said members being secured to an extended end portion of one of said rear beam portions for securement of the front and rear beam portions of one subassembly in axial alignment with the front and rear beam portions of another subassembly;

at least one attachment member in each subassembly secured to and extending between each said subassembly and a wooden frame in a soft story building whereby the load of the building is transferred to the metal frame assembly during a seismic condition; and a pair of cover plates welded to opposed sides of the front and rear column portions in each of said subassemblies, each of said cover plates spanning a pair of said flanges in opposed axial alignment and being disposed below and vertically spaced from said connector plates so as to define a plastic hinge zone in an upper portion of said column portions of said frame assembly between said cover plates.

14. The metal frame assembly of claim 13 wherein said at least one attachment member comprises at least one metal strap secured to and extending between the beam of a wooden frame and said column portions of the metal frame assembly.

15. The metal frame assembly of claim 13 wherein said flanges in opposed axial alignment in each of said subassemblies define a pair of elongated gaps therebetween, a plurality of fastening members, at least one of said fastening members extending through each of said gaps and a pair of flange restraining plates carried by opposed ends of each of said fastening members, whereby at least one pair of said restraining plates are slidably mounted along each of said gaps adjacent to opposed sides of said aligned flanges, inhibiting buckling of said flanges in said plastic hinge zone during a seismic condition.

16. The metal frame assembly of claim 15 wherein said at least one attachment member comprises at least one metal strap secured to and extending between the beam of a wooden frame and said column portions of the metal frame assembly.

17. The metal frame assembly of claim 13 wherein each column portion defines an upstanding plate projecting from an upper end thereof such that upon said front and rear column portions in each subassembly being secured about the upstanding columns on the wood frame, said upstanding plates are disposed proximate opposed sides of the wooden beam and including a first metal strap in each subassembly secured to and extending between the beam of the wooden frame and the upstanding plate on the front column portion of the subassembly and a second metal strap secured to and extending between the beam of the wooden frame and the upstanding plate on the rear column portion of the subassembly.

18. A metal frame assembly for seismic retrofitting of soft story buildings having a large opening on the ground floor thereof and a wooden frame disposed about the opening comprised of a pair of laterally spaced upstanding columns and a wooden beam extending horizontally therebetween over the opening, said metal frame assembly comprising:

a pair of front steel channel column portions and a pair of rear steel channel column portions, said column portions being configured such that the front column portions in each such pair thereof cooperates with a rear column portion in the other pair in opposed juxtaposition to define a pair of steel columns for extending about and substantially encasing the upstanding columns of a wooden frame in a soft story building;

front and rear beam portions defining extended end portions, said end portions being secured to and carried by upper portions of said steel columns such that with said front and rear column portions being secured about the upstanding columns of the wooden frame, said beam portions extend horizontally from said steel columns parallel to and laterally spaced from opposed sides of the beam in the wooden frame;

a plurality of steel connector plates, carried by and secured to said extended end portions of said beam portions and said upper portions of said front and rear column portions, said plates securing together the front beam portion to the front column portions, the rear beam portion to the rear column portions and said front and rear column and beam portions to the wooden beam portion of a frame in a soft story building; and a pair of attachment members, one of said members being secured to and extending between one of said steel columns and a wooden frame in a soft story building and the other of said members being secured to and extending between the other of said steel columns and said wooden frame whereby the load of the building is transferred to the metal frame assembly during a seismic condition.

19. The metal frame assembly of claim 18 wherein one of said plurality of connector plates is welded to each of the extended end portions of the front and rear beam portions of the frame assembly, one of said plurality of connector plates is welded to an upper portion of each of the front and rear column portions of the frame assembly, said connector plates welded to said extended end portions of said front beam portions and said connector plates welded to said upper portions of said front column portion being secured together in adjacent juxtaposition between said front beam and column portions, said connector plates welded to said extended end portions of said rear beam portion and said connector plates welded to said upper portions of said rear column portions being secured together in adjacent juxtaposition between said rear beam and column portions, and a pair of axially spaced fastening members extending through said front beam portion proximate each extended end thereof, through the connector plates welded to said front beam portion, through said front column portions proximate the upper portions thereof, through the wooden beam, through said rear beam portion proximate the extended ends thereof and through said connector plates welded to said rear beam portions whereby said beam and column portions are secured together and to the wooden beam of a soft story building and said beam portions of said frame assembly are inhibited from twisting relative to said column portions during a seismic condition.

20. The metal frame assembly of claim 19 wherein the connector plates welded to the extended end portions of the front beam portion of the frame assembly are secured in adjacent juxtaposition to the connector plates welded to the upper portions of the front column portions below the wooden beam on a front side thereof by a first plurality of threaded fastening members and the connector plates welded to the extended end portions of the rear beam portion are secured together in adjacent juxtaposition to the connector plates welded to the upper portions of the rear column portions below the wooden beam on the rear side thereof by a second plurality of threaded fastening members.

21. The metal frame assembly of claim 18 wherein said at least one attachment member comprises at least one metal strap secured to and extending between each of said metal columns and an adjacent portion of the beam of the wooden frame.

22. The metal frame assembly of claim 19 wherein said at least one attachment member comprises at least one metal strap secured to and extending between each of said metal columns and an adjacent portion of the beam of the wooden frame.

23. The metal frame assembly of claim 18 wherein each column portion defines an upstanding plate projecting from an upper end thereof such that upon said front and rear column portions being secured about an upstanding column on the wood frame, said upstanding plates are disposed proximate opposed sides of the wooden beam and wherein said at least one attachment member comprises a first metal strap proximate each of said steel columns secured to and extending between the beam of the wooden frame and the upstanding plate on the front column portions of the steel columns and a second metal strap proximate each end of said steel columns secured to and extending between the beam of the wooden frame and the upstanding plate on the rear column portion of the steel columns.

24. The metal frame assembly of claim 18 wherein one of said plurality of connector plates is welded to each of the extended end portions of the front beam portion and to an upper portion of a front column portion of the frame assembly and one of said plurality of connector plates is welded to each of the extended end portions of the rear beam portion and to an upper portion of a rear column portion of the frame assembly, and a pair of axially spaced fastening members extend through said front beam portion proximate each end portion thereof, through an adjacent connector plate, through said front column portions proximate upper ends thereof, through the wooden beam through the rear column portion proximate the extended ends thereof and through an adjacent connector plate and said rear beam portion proximate the extended ends thereof, whereby said beam and column portions in said assembly are secured together and to the wooden beam of a soft story building and said beam portions of said frame assembly are inhibited from twisting relative to said column portions during a seismic condition.

25. The metal frame assembly of claim 24 wherein said at least one attachment member comprises at least one metal strap secured to and extending between each of said steel columns proximate portions of the beam of the wooden frame.

26. The metal frame assembly of claim 24 wherein each column portion defines an upstanding plate projecting from an upper end thereof such that upon said front and rear column portions being secured about an upstanding columns on the wood frame, said upstanding plates are disposed proximate opposed sides of the wooden beam and wherein said at least one attachment member comprises a first metal strap proximate each of said steel columns secured to and extending between the beam of the wooden frame and the upstanding plate on the front column portions of the steel columns and a second metal strap proximate each end of said steel columns secured to and extending between the beam of the wooden frame and the upstanding plate on the rear column portion of the steel columns.

27. The metal frame assembly of claim 19 including a pair of cover plates welded to opposed sides of each of said steel columns, said cover plates spanning the front and rear column portions and being disposed below and vertically spaced from said plurality of connector plates so as to define a plastic hinge zone in an upper portion of said steel columns between said cover plates.

28. The metal frame assembly of claim 18 wherein each of said front and rear column portions defines a pair of spaced flanges and a web extending therebetween such that upon said front and rear column portions being secured in opposed juxtaposition about the upstanding columns of a wooden frame, said flanges on said front and rear column portions are in opposed alignment about portions of the wooden column and a pair of cover plates welded to opposed sides of each of said steel columns, each of said cover plates spanning a pair of said flanges in opposed axial alignment and being disposed below and vertically spaced from said plurality of connector plates so as to define a plastic hinge zone in an upper portion of said steel columns between said cover plates.

29. The metal frame assembly of claim 28 wherein said at least one attachment member comprises at least one metal strap proximate each end of said frame assembly secured to and extending between the beam of the wooden frame and an adjacent column portions of the metal frame assembly.

30. The metal frame assembly of claim 29 wherein said flanges in opposed axial alignment in each of said front and rear column portions disposed about a wooden column define a pair of elongated gaps therebetween, a plurality of fastening members, at least one of said fastening members extending through each of said gaps and a pair of flange restraining plates carried by opposed ends of each of said fastening members, whereby at least one pair of said restraining plates are slidably mounted along each of said gaps adjacent to opposed sides of said aligned flanges, inhibiting buckling of said flanges in said plastic hinge zone during a seismic condition.

31. The metal frame assembly of claim 30 wherein said at least one attachment member comprises at least one metal strap secured to and extending between each of said steel columns proximate portions of the beam of the wooden frame.

32. The metal frame assembly of claim 18 including a plastic hinge zone in the front and rear column portions of said steel columns below and proximate said connector plates whereby flexing of said metal frame assembly in said plastic hinge zones during an earthquake is facilitated.

33. A metal frame assembly for seismic retrofitting of soft story buildings having a large opening on the ground floor thereof and a wooden frame disposed about the opening comprised of a pair of laterally spaced upstanding columns and a wooden beam extending horizontally therebetween over the opening, said metal frame assembly comprising:

a pair of front steel channel column portions and a pair of rear steel channel column portions, said column portions being configured such that the front column portions in each such pair thereof cooperates with a rear column portion in the other pair in opposed juxtaposition to define a pair of steel columns for extending about and substantially encasing the upstanding columns of a wooden frame in a soft story building;

front and rear beam portions defining extended end portions, said end portions being secured to and carried by upper portions of said steel columns such that with said front and rear column portions being secured about the upstanding columns of the wooden frame, said beam portions extend horizontally from said steel columns parallel to and laterally spaced from opposed sides of the beam in the wooden frame;

a plurality of steel connector plates, carried by and secured to said extended end portions of said beam portions and said upper portions of said front and rear column portions, said plates securing together the front beam portion to the front column portions, the rear beam portion to the rear column portions and said front and rear column and beam portions to the wooden beam portion of a frame in a soft story building;

a pair of attachment members, one of said members being secured to and extending between one of said steel columns and a wooden frame in a soft story building and the other of said members being secured to and extending between the other of said steel columns and said wooden frame whereby the load of the building is transferred to the metal frame assembly during a seismic condition; and a pair of cover plates welded to opposed sides of each of said steel columns, said cover plates spanning the front and rear column portions and being disposed below and vertically spaced from said plurality of connector plates so as to define a plastic hinge zone in an upper portion of said steel columns between said cover plates.

34. The metal frame assembly of claim 33 wherein said at least one attachment member comprises at least one metal strap secured to and extending between each of said steel columns proximate portions of the beam of the wooden frame.

35. A metal frame assembly for seismic retrofitting of soft story buildings having a large opening on the ground floor thereof and a wooden frame disposed about the opening comprised of a pair of laterally spaced upstanding columns and a wooden beam extending horizontally therebetween over the opening, said metal frame assembly comprising:

a pair of half frame subassemblies, each subassembly being adapted to be secured to a wooden beam in a soft story building whereby the load of the building is transferred to the metal frame assembly during seismic conditions and wherein such subassembly comprises front and rear steel channel column portions and front and rear steel channel beam portions;

said front and rear column portions in each subassembly being configured to extend about and substantially encase a column of a wooden frame in a soft story building;

said front and rear beam portions in each subassembly being secured to and carried by upper portions of said column portions in each said subassembly such that with said front and rear column portions being secured about the upstanding columns of the wooden frame, said beam portions extend horizontally from said column portions and parallel to the wooden beam;

a plurality of steel connector plates in each of said subassemblies securing together the front beam portion to the front column portion and the rear beam portion to the rear column portion;

at least two steel connecting members, one of said members being secured to an extended end portion of one of said front beam portions and another of said members being secured to an extended end portion of one of said rear beam portions for securement of the front and rear beam portions of one subassembly in axial alignment with the front and rear beam portions of another subassembly;

at least one attachment member in each subassembly secured to and extending between each said subassembly and a wooden frame in a soft story building whereby the load of the building is transferred to the metal frame assembly during a seismic condition; and wherein each column portion defines an upstanding plate projecting from an upper end thereof such that upon said front and rear column portions in each subassembly being secured about the upstanding columns on the wood frame, said upstanding plates are disposed proximate opposed sides of the wooden beam and including a first metal strap in each subassembly secured to and extending between the beam of the wooden frame and the upstanding plate on the front column portion of the subassembly and a second metal strap secured to and extending between the beam of the wooden frame and the upstanding plate on the rear column portion of the subassembly.

36. A metal frame assembly for seismic retrofitting of soft story buildings having a large opening on the ground floor thereof and a wooden frame disposed about the opening comprised of a pair of laterally spaced upstanding columns and a wooden beam extending horizontally therebetween over the opening, said metal frame assembly comprising:

a pair of front steel channel column portions and a pair of rear steel channel column portions, said column portions being configured such that the front column portions in each such pair thereof cooperates with a rear column portion in the other pair in opposed juxtaposition to define a pair of steel columns for extending about and substantially encasing the upstanding columns of a wooden frame in a soft story building;

front and rear beam portions defining extended end portions, said end portions being secured to and carried by upper portions of said steel columns such that with said front and rear column portions being secured about the upstanding columns of the wooden frame, said beam portions extend horizontally from said steel columns parallel to and laterally spaced from opposed sides of the beam in the wooden frame;

a plurality of steel connector plates securing together the front beam portion to the front column portion and the rear beam portion to the rear column portion; and a plastic hinge zone in the front and rear column portions of said steel columns below and proximate said connector plates whereby flexing of said metal frame assembly in said plastic hinge zones during an earthquake is facilitated.

37. A metal frame assembly for seismic retrofitting of soft story buildings having a large opening on the ground floor thereof and a wooden frame disposed about the opening comprised of a pair of laterally spaced upstanding columns and a wooden beam extending horizontally therebetween over the opening, said metal frame assembly comprising:

a pair of front steel channel column portions and a pair of rear steel channel column portions, each of said front and rear channel column portions defining a pair of spaced parallel flanges whereby upon the front column portions in each such pair thereof being disposed in opposed juxtaposition to one of said rear channel column portions, said flanges on said front and rear column portions cooperate to define a pair of steel columns for extending about and substantially encasing the upstanding columns of a wooden frame in a soft story building;

a pair of front and rear beam portions, each of said front and rear beam portions defining a pair of spaced parallel flanges and extended end portions, said extended end portions being secured to and carried by upper portions of said steel columns such that with said front and rear column portions being secured about the upstanding columns of the wooden frame, said beam portions extend horizontally from said steel columns parallel to and laterally spaced from opposed sides of the beam in the wooden frame and said flanges on said front and rear beam portions extend outwardly from the opposed sides of the beam in the wooden frame; and wherein said front beam and rear beam portions respectively are secured to said opposed front and rear column portions and said front and rear beam and column portions are secured to the beam in the wooden frame.

38. The metal frame assembly of claim 37 including a plastic hinge zone in said front and rear column portions of said steel columns below and proximate said steel front and rear beam portions.

39. The metal frame assembly of claim 37 wherein said front and rear beam portions respectively are welded to said front and rear column portions and with said front and rear column portions threadably engage the beam in the wooden frame.

40. The metal frame assembly of claim 38 wherein at least one flange restraining plate spanning the flanges on said pairs of opposed front and rear column portions is slidably mounted along each of said plastic hinge zones in said steel columns.

* * * * *